US011450498B2

(12) United States Patent
Otsuka et al.

(10) Patent No.: US 11,450,498 B2
(45) Date of Patent: Sep. 20, 2022

(54) RELAY

(71) Applicant: OMRON Corporation, Kyoto (JP)

(72) Inventors: Kohei Otsuka, Omuta (JP); Ryota Minowa, Yamaga (JP); Hiroyuki Iwasaka, Kumamoto (JP); Yasuo Hayashida, Kumamoto (JP); Shingo Mori, Yamaga (JP); Naoki Kawaguchi, Yame (JP)

(73) Assignee: OMRON CORPORATION, Kyoto (JP)

( * ) Notice: Subject to any disclaimer, the term of this patent is extended or adjusted under 35 U.S.C. 154(b) by 9 days.

(21) Appl. No.: 17/262,212

(22) PCT Filed: Feb. 19, 2019

(86) PCT No.: PCT/JP2019/006167
§ 371 (c)(1),
(2) Date: Jan. 22, 2021

(87) PCT Pub. No.: WO2020/031402
PCT Pub. Date: Feb. 13, 2020

(65) Prior Publication Data

US 2021/0304993 A1 Sep. 30, 2021

(30) Foreign Application Priority Data

Aug. 10, 2018 (JP) ..... JP2018-151594

(51) Int. Cl.
*H01H 3/00* (2006.01)
*H01H 50/54* (2006.01)
(Continued)

(52) U.S. Cl.
CPC ..... *H01H 50/546* (2013.01); *H01H 33/18* (2013.01); *H01H 50/10* (2013.01); *H01H 50/18* (2013.01)

(58) Field of Classification Search
CPC ..... H01H 50/546; H01H 33/18; H01H 50/10; H01H 50/18; H01H 1/24; H01H 9/30; H01H 50/38
(Continued)

(56) References Cited

U.S. PATENT DOCUMENTS

2004/0092980 A1* 5/2004 Cesarini ..... A61B 17/32002 606/159
2012/0175345 A1 7/2012 Tachikawa et al.
(Continued)

FOREIGN PATENT DOCUMENTS

JP 2012-104360 A 5/2012
JP 2012-160427 A 8/2012
(Continued)

OTHER PUBLICATIONS

The International Search Report of International Application No. PCT/JP2019/006167 dated May 7, 2019.
(Continued)

*Primary Examiner* — Shawki S Ismail
*Assistant Examiner* — Lisa N Homza
(74) *Attorney, Agent, or Firm* — Shinjyu Global IP

(57) ABSTRACT

A relay, including a first fixed contact, a second fixed contact, a movable contact piece having first and second movable contacts, a contact piece holding unit configured to hold the movable contact piece, a magnet for arc extinguishing, and a debris suction unit configured to exert a magnetic force to suck debris, is disclosed. A first contact position between the first fixed contact and the first movable contact is located between the magnet for arc extinguishing and the contact piece holding unit in a longitudinal direction of the movable contact piece. The debris suction unit is disposed so that the first contact position does not overlap a region between the debris suction unit and the contact piece holding
(Continued)

unit. A magnet force exerted by the debris suction unit in the contact piece holding unit is larger than a magnetic force exerted by the magnet in the contact piece holding unit.

14 Claims, 11 Drawing Sheets

(51) Int. Cl.
*H01H 33/18* (2006.01)
*H01H 50/10* (2006.01)
*H01H 50/18* (2006.01)

(58) Field of Classification Search
USPC ..... 335/185
See application file for complete search history.

(56) References Cited

U.S. PATENT DOCUMENTS

2014/0182627 A1* 7/2014 Williams ..... A47L 11/4088 134/21
2018/0295979 A1* 10/2018 Miller ..... A46B 15/0038
2019/0338481 A1* 11/2019 Covington ..... E02B 15/106
2021/0362080 A1* 11/2021 Granot ..... B01D 35/30
2022/0056655 A1* 2/2022 Covington ..... E02B 15/047

FOREIGN PATENT DOCUMENTS

JP 2015-159131 A 9/2015
JP 2016-12504 A 1/2016
JP 2016-12505 A 1/2016
JP 2016-24864 A 2/2016
JP 2016-72021 A 5/2016
JP 2016-134308 A 7/2016

OTHER PUBLICATIONS

The Written Opinion of the International Searching Authority of International Application No. PCT/JP2019/006167 dated May 7, 2019.
The Office Action of the corresponding Japanese application No. 2018-151594 dated Feb. 22, 2022.

* cited by examiner

RELAY

CROSS-REFERENCE TO RELATED APPLICATION

This application is the U.S. National Phase of International Application No. PCT/JP2019/006167, filed on Feb. 19, 2019. This application claims priority to Japanese Patent Application No. 2018-151594, filed Aug. 10, 2018. The contents of that application are incorporated by reference herein in their entireties.

FIELD

The present invention relates to a relay.

BACKGROUND

Some relays are equipped with a magnet for arc extinguishing that occurs at contact points. For example, in Japanese Patent Application Publication No. 2016-12504A, two magnets are arranged so as to mutually oppose each other in the longitudinal direction of a movable contact piece. The movable contact piece is arranged between the two magnets. When an arc is generated between the contact points, a Lorentz force acts on the arc due to the magnetic force of the magnets. Thereby, the arc is extinguished quickly as a result of the arc being stretched.

SUMMARY

On the other hand, the relay is configured with a contact piece holding unit holding the movable contact piece. The contact piece holding unit includes, for example, components such as a holder, a drive shaft, and a spring, which are mounted to the movable contact piece. When the movable contact piece operates to open and close the contacts, wear debris is generated due to friction between the movable contact piece and the contact piece holding unit or friction between the components of the contact piece holding unit.

In a relay equipped with a magnet as described above, wear debris is attracted to the magnet by the magnetic force of the magnet. Therefore, if the movable contact and the fixed contact are arranged between the magnet and the contact piece holding unit, the wear debris may be caught between the movable contact and the fixed contact. In this case, the contact resistance between the contacts may become large, deteriorating the energization performance.

An object of the present invention is to be able to quickly extinguish an arc with the magnet and to reduce deterioration of the energization performance due to wear debris.

A relay according to one aspect includes a first fixed contact, a second fixed contact, a movable contact piece, a contact piece holding unit, a magnet for arc extinguishing, and a debris suction unit. The movable contact piece includes a first movable contact and a second movable contact arranged apart from each other in a longitudinal direction of the movable contact piece. The movable contact piece is movably disposed in a direction in which the first movable contact and the second movable contact come into contact with the first fixed contact and the second fixed contact and in a direction in which they are separated from the first fixed contact and the second fixed contact. The contact piece holding unit holds the movable contact piece. The magnet is arranged laterally to the movable contact piece in the longitudinal direction of the movable contact piece. The debris suction unit exerts a magnetic force so as to suck debris generated in the contact piece holding unit.

A first contact position between the first fixed contact and the first movable contact is located between the magnet and the contact piece holding unit in the longitudinal direction of the movable contact piece. The debris suction unit is disposed so that the first contact position does not overlap the region between the debris suction unit and the contact piece holding unit. The magnetic force exerted by the debris suction unit in the contact piece holding unit is larger than a magnetic force exerted by the magnet in the contact piece holding unit.

In the relay according to the present aspect, an arc can be quickly extinguished by the magnet. Further, even if wear debris is generated in the contact piece holding unit due to wear, the wear debris can be sucked by the debris suction unit. Therefore, it is possible to reduce the risk that the wear debris could be caught between the first movable contact and the first fixed contact. As a result, a decrease in energization performance due to wear debris can be reduced.

The debris suction unit in the contact piece holding unit may have a magnetic flux density that is larger than a magnetic flux density of the magnet in the contact piece holding unit. In this case, the wear debris generated in the contact piece holding unit is attracted more strongly to the debris suction unit than to the magnet. As a result, it is possible to more effectively reduce the risk that the wear debris could be caught between the first movable contact and the first fixed contact.

The debris suction unit may be disposed in a direction intersecting the longitudinal direction of the movable contact piece with respect to the contact piece holding unit. In this case, the wear debris is sucked by the debris suction unit and moves in a direction different from the direction toward the first contact position. As a result, it is possible to more effectively reduce the risk that the wear debris could be caught between the first movable contact and the first fixed contact.

The debris suction unit may be disposed apart from the contact piece holding unit in the width direction of the movable contact piece that intersects the longitudinal direction of the movable contact piece. In this case, the wear debris is sucked by the debris suction unit and moves in a direction different from the direction toward the first contact position. As a result, it is possible to more effectively reduce the risk that the wear debris could be caught between the first movable contact and the first fixed contact.

The distance between the debris suction unit and the contact piece holding unit in the width direction of the movable contact piece may be smaller than the distance between the magnet and the contact piece holding unit in the longitudinal direction of the movable contact piece. In this case, the debris suction unit is arranged closer to the contact piece holding unit than the magnet in the width direction of the movable contact piece. Therefore, the wear debris generated in the contact piece holding unit is attracted more strongly to the debris suction unit than to the magnet. As a result, it is possible to more effectively reduce the risk that the wear debris could be caught between the first movable contact and the first fixed contact.

The debris suction unit may be disposed apart from the contact piece holding unit in a moving direction of the movable contact piece. In this case, the wear debris is sucked by the debris suction unit and moves in a direction different from the direction toward the first contact position. As a result, it is possible to more effectively reduce the risk that the wear debris could be caught between the first movable contact and the first fixed contact.

The distance between the debris suction unit and the contact piece holding unit in the moving direction of the movable contact piece may be smaller than the distance between the magnet and the contact piece holding unit in the longitudinal direction of the movable contact piece. In this case, the debris suction unit is arranged closer to the contact piece holding unit than the magnet in the moving direction of the movable contact piece. Therefore, the wear debris generated in the contact piece holding unit is attracted more strongly to the debris suction unit than to the magnet. As a result, it is possible to more effectively reduce the risk that the wear debris could be caught between the first movable contact and the first fixed contact.

At least a part of the debris suction unit may lie between the first contact position and the contact piece holding unit in the longitudinal direction of the movable contact piece. In this case, the wear debris generated in the contact piece holding unit is sucked by the debris suction unit, so that it is prevented from reaching the first contact position. As a result, it is possible to more effectively reduce the risk that the wear debris could be caught between the first movable contact and the first fixed contact.

The debris suction unit may be a permanent magnet. In this case, the wear debris can be attracted by the magnetic force generated from the permanent magnet.

The debris suction unit may include a yoke connected to the magnet for arc extinguishing. In this case, the wear debris can be sucked by the magnetic flux generated from the arc extinguishing magnet and guided by the yoke.

The debris suction unit may include a permanent magnet and a yoke connected to the permanent magnet. In this case, the wear debris can be sucked by the magnetic flux generated from the permanent magnet and induced by the yoke.

The relay may further include a cover member covering the debris suction unit. In this case, the debris suction unit can be protected from the arc generated at the contact point.

The relay may further include a magnetic shield. The magnetic shield may be disposed between the first contact position and the contact piece holding unit in the longitudinal direction of the movable contact piece. In this case, by weakening the magnetic force exerted on the wear debris by the magnet for arc extinguishing, the attractive force on the wear debris by the debris suction unit can be relatively increased.

The debris suction unit may have a surface with an uneven texture. In this case, more wear debris can be collected to the debris suction unit.

DETAILED DESCRIPTION

Figure 1:
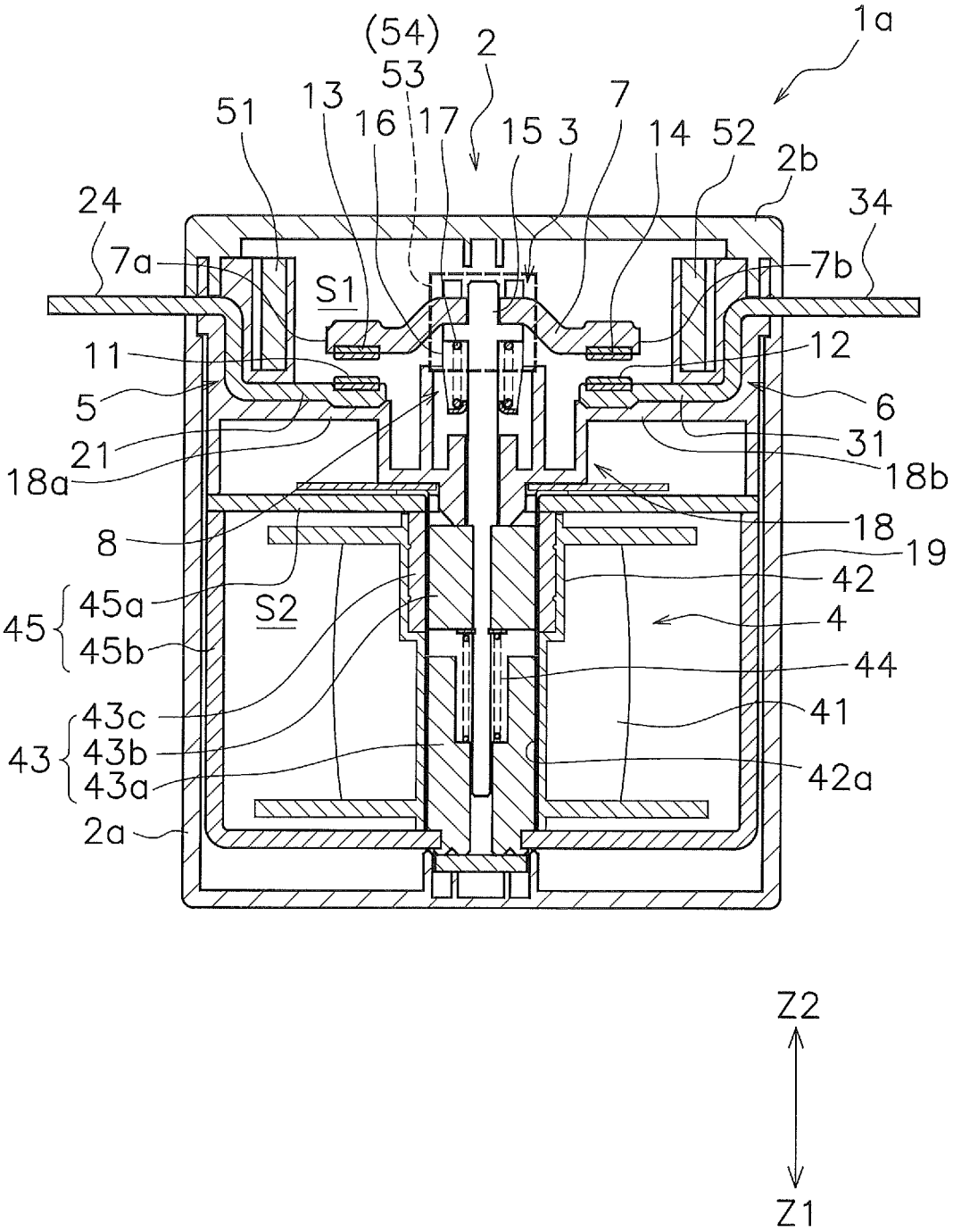
FIG. 1 is a side sectional view showing a relay according to the first embodiment.

Hereinafter, a relay 1 according to the embodiment will be described with reference to the drawings. FIG. 1 is a side sectional view showing a relay 1*a* according to a first embodiment. As shown in FIG. 1, the relay 1*a* includes a case 2, a contact device 3, and a drive device 4. In the following description, each direction of up/down/left/right means each direction of up/down/left/right in FIG. 1. Further, the front-back direction is assumed to mean a direction perpendicular to the paper surface of FIG. 1. However, the definitions of these directions do not limit the arrangement direction of the relay 1*a*.

The case 2 houses the contact device 3 and the drive device 4. The case 2 is made of an insulating resin. The case 2 includes a case body 2*a* and a lid 2*b*. The contact device 3 and the drive device 4 are arranged in the case body 2*a*. The lid 2*b* is separate from the case body 2*a*. The lid 2*b* is attached to the case body 2*a*. The case body 2*a* includes a contact case 18 and an outer case 19. The contact case 18 defines a first storage portion S1 and a second storage portion S2 in the case 2. The first storage portion S1 accommodates the contact device 3 inside. The second storage portion S2 accommodates the drive device 4 inside. The outer case 19 accommodates the contact case 18 inside.

The contact device 3 includes a first fixed terminal 5, a second fixed terminal 6, a movable contact piece 7, and a contact piece holding unit 8. The first fixed terminal 5, the second fixed terminal 6, and the movable contact piece 7 are formed of a conductive material such as copper. The first fixed terminal 5 includes a first fixed contact 11. The second fixed terminal 6 includes a second fixed contact 12. The first fixed contact 11 and the second fixed contact 12 are arranged apart from each other in the left-right direction.

The movable contact piece 7 extends in the left-right direction. In the present embodiment, the longitudinal direction of the movable contact piece 7 coincides with the left-right direction thereof. The movable contact piece 7 includes a first movable contact 13 and a second movable contact 14. The first movable contact 13 and the second movable contact 14 are arranged apart from each other in the left-right direction. The first movable contact 13 is arranged to face the first fixed contact 11. The second movable contact 14 is arranged to face the second fixed contact 12.

The movable contact piece 7 includes a first end portion 7*a* and a second end portion 7*b*. The first end portion 7*a* is one end portion of the movable contact piece 7 in the left-right direction. The second end portion 7*b* is the other end portion of the movable contact piece 7 in the left-right direction. In the present embodiment, the first end portion 7*a* is the left end portion of the movable contact piece 7. The second end portion 7*b* is the right end portion of the movable contact piece 7. The first movable contact 13 is arranged between the center of the movable contact piece 7 in the left-right direction and the first end portion 7*a*. The second movable contact 14 is arranged between the center of the movable contact piece 7 and the second end portion 7*b* in the left-right direction.

The movable contact piece 7 is arranged so as to be movable in the up-down direction. Specifically, the movable contact piece 7 is movably arranged in a contact direction Z1 and a separating direction Z2. The contact direction Z1 is the direction in which the first movable contact 13 and the second movable contact 14 come into contact with the first fixed contact 11 and the second fixed contact 12 (downward in FIG. 1). The separating direction Z2 is the direction in which the first movable contact 13 and the second movable contact 14 are separated from the first fixed contact 11 and the second fixed contact 12 (upward in FIG. 1).

The contact piece holding unit 8 holds the movable contact piece 7. The contact piece holding unit 8 holds the movable contact piece 7 at the center of the movable contact piece 7 in the left-right direction. Therefore, the contact piece holding unit 8 holds the movable contact piece 7 at a position between the first movable contact 13 and the second movable contact 14 in the left-right direction.

The contact piece holding unit 8 includes a drive shaft 15, a holder 16, and a contact spring 17. The drive shaft 15, the holder 16, and the contact spring 17 are made of a metal such as stainless steel. However, the drive shaft 15, the holder 16, and the contact spring 17 may be made of a metal other than stainless steel. Alternatively, a part of the contact piece holding unit 8 may be made of a material other than metal such as resin.

The drive shaft 15 extends in the up-down direction. The drive shaft 15 connects the movable contact piece 7 and the drive device 4. The drive shaft 15 is movably arranged in the contact direction Z1 and the separating direction Z2. The holder 16 is connected to the movable contact piece 7 and holds the movable contact piece 7. The contact spring 17 is arranged between the drive shaft 15 and the holder 16. The drive shaft 15 is connected to the holder 16 via a contact spring 17.

The first fixed terminal 5 includes a first contact support portion 21 and a first external connection portion 24. The first contact support portion 21 supports the first fixed contact 11 in the case 2. The first external connection portion 24 is connected to the first contact support portion 21. The first external connection portion 24 protrudes outward from the case 2. The first external connection portion 24 may be integrally formed with the first contact support portion 21. Alternatively, the first external connection portion 24 may be separate from the first contact support portion 21.

The second fixed terminal 6 includes a second contact support portion 31 and a second external connection portion 34. The second contact support portion 31 supports the second fixed contact 12 in the case 2. The second external connection portion 34 is connected to the second contact support portion 31. The second external connection portion 34 protrudes outward from the case 2. The second external connection portion 34 may be integrally formed with the second contact support portion 31. Alternatively, the second external connection portion 34 may be separate from the second contact support portion 31.

The drive device 4 generates a driving force for operating the movable contact piece 7. The drive device 4 operates the movable contact piece 7 by an electromagnetic force. The drive device 4 is arranged below the movable contact piece 7. The drive device 4 includes a coil 41, a spool 42, an iron core 43, a return spring 44, and a yoke 45.

The coil 41 is wound around the spool 42. The coil 41 and the spool 42 are arranged coaxially with the drive shaft 15. The spool 42 has a hole 42*a* penetrating in the axial direction of the spool 42. The iron core 43 and the return spring 44 are inserted into the hole 42*a* of the spool 42. The yoke 45 is connected to the iron core 43.

The yoke 45 includes a first yoke 45*a* and a second yoke 45*b*. The first yoke 45*a* is arranged between the contact device 3 and the spool 42. The second yoke 45*b* is connected to the first yoke 45*a*. The second yoke 45*b* has a U-shape. The second yoke 45*b* is arranged on both sides of the coil 41 and on the opposite side of the first yoke 45*a* with respect to the coil 41.

The iron core 43 includes a fixed iron core 43*a*, a movable iron core 43*b*, and a ring iron core 43*c*. The fixed iron core 43*a* is fixed to the second yoke 45*b*. The ring iron core 43*c* is in contact with the first yoke 45*a*. The movable iron core 43*b* is separate from the fixed iron core 43*a* and the ring iron core 43*c*. The movable iron core 43*b* is movably arranged in the contact direction Z1 and the separating direction Z2. The movable iron core 43*b* moves within the ring iron core 43*c*. The movable iron core 43*b* is connected to the drive shaft 15. The return spring 44 is arranged between the movable iron core 43*b* and the fixed iron core 43*a*. The return spring 44 urges the movable iron core 43*b* in the separating direction Z2.

Figure 2A:
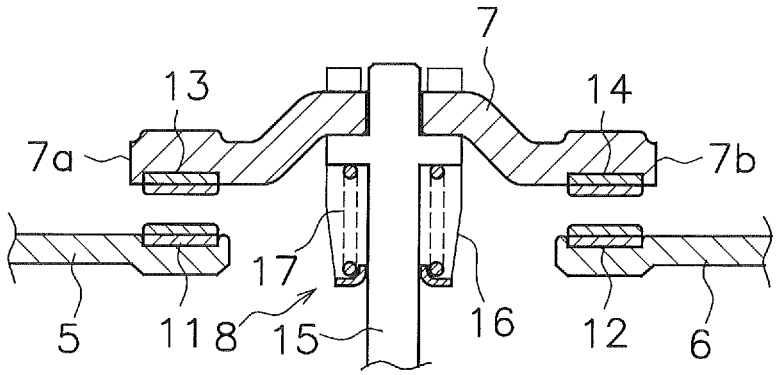
FIGS. 2A and 2B are diagrams showing the operation of a movable contact piece.
Figure 2B:
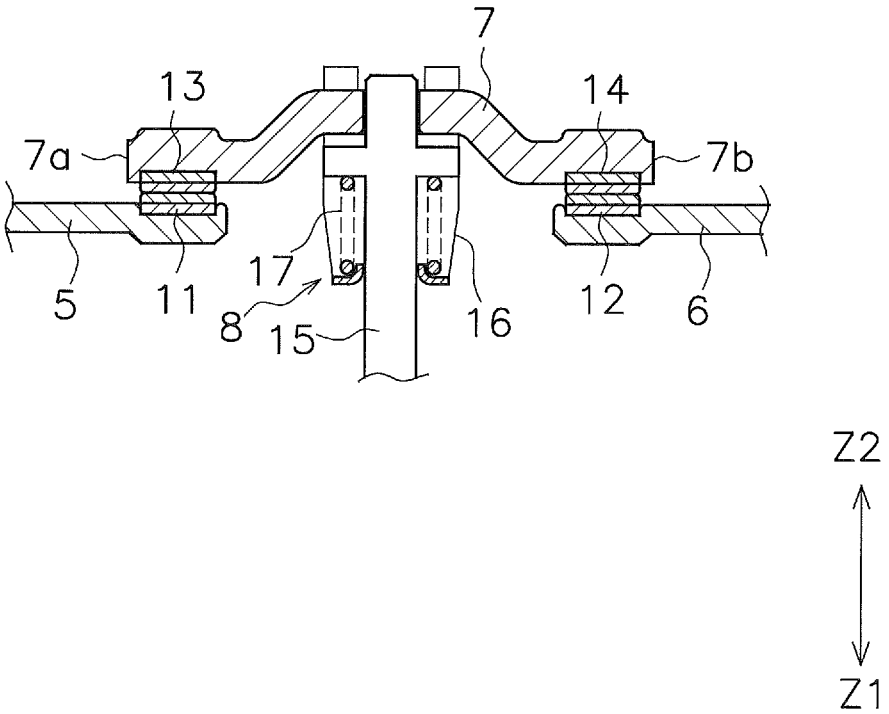

Next, the operation of the relay 1*a* will be described. FIGS. 2A and 2B are diagrams showing the operation of the movable contact piece 7. When the coil 41 is not excited due to no electric current being passed therethrough, the drive shaft 15 is in a pressed state in the separating direction Z2 by the elastic force of the return spring 44 together with the movable iron core 43*b*. Therefore, the movable contact piece 7 is also in a pressed state in the separating direction Z2, and as shown in FIG. 2A, the first movable contact 13 and the second movable contact 14 assume an open state separated from the first fixed contact 11 and the second fixed contact 12.

When the coil 41 is excited by an electric current being passed therethrough, the movable iron core 43*b* moves in the contact direction Z1 against the elastic force of the return spring 44 due to the electromagnetic force of the coil 41. As a result, as shown in FIG. 2B, the drive shaft 15, the holder 16, and the movable contact piece 7 all move in the contact direction Z1, whereby the first movable contact 13 and the second movable contact 14 come into contact with the first fixed contact 11 and the second fixed contact 12.

When the electric current to the coil 41 is stopped and the coil 41 is demagnetized, the drive shaft 15 together with the movable iron core 43*b* is pressed in the separating direction Z2 by the elastic force of the return spring 44. For that reason, when the movable contact piece 7 is also pressed in the separating direction Z2, the first movable contact 13 and the second movable contact 14 return to the open state as shown in FIG. 2A.

Figure 3:
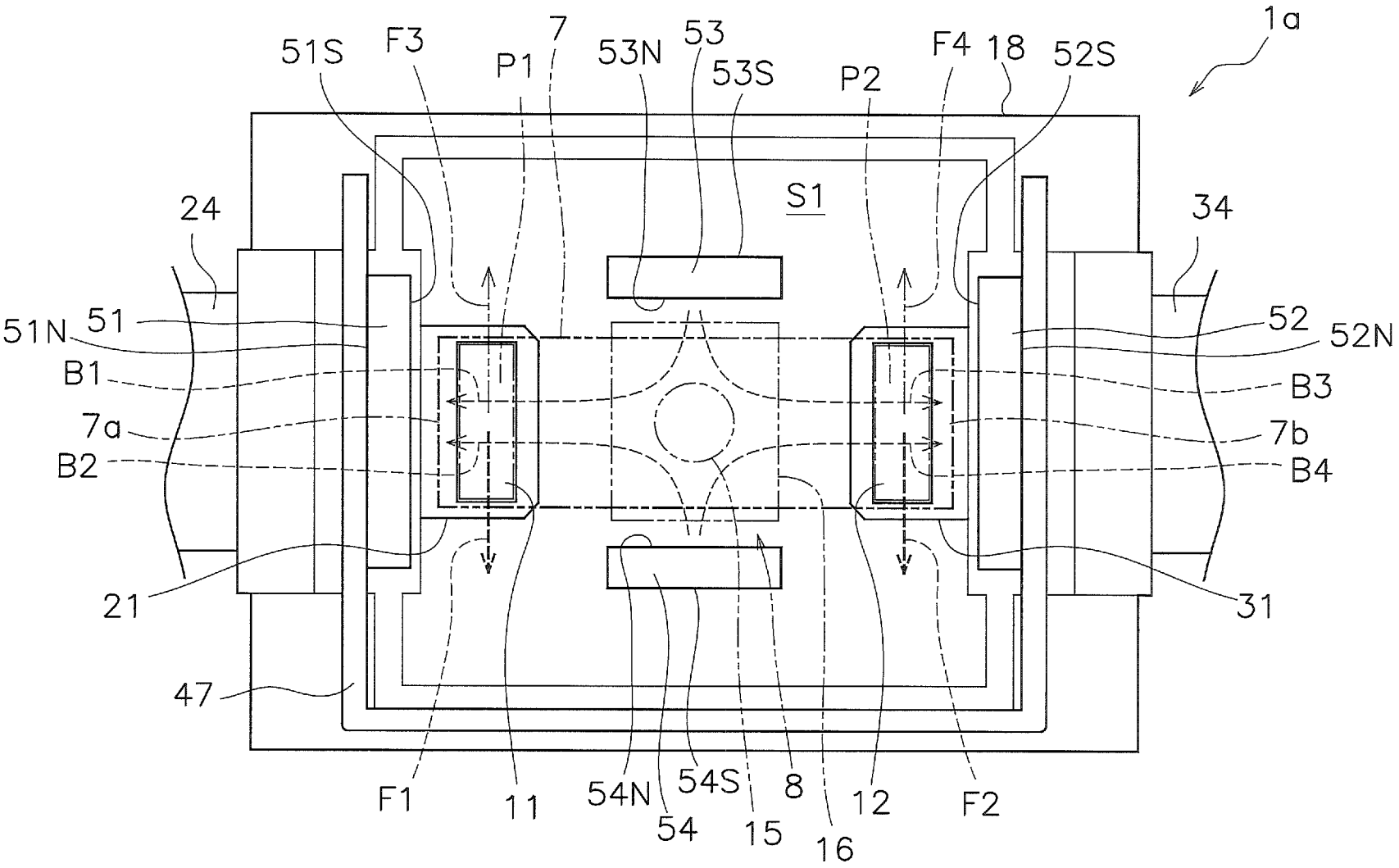
FIG. 3 is a plan view showing a configuration inside a contact case of the relay according to the first embodiment.

FIG. 3 is a plan view showing a configuration inside of the relay 1*a* in the contact case 18. In FIG. 3, the positions of the movable contact piece 7 and the contact piece holding unit 8 are indicated by a dashed line. As shown in FIGS. 1 and 3, the relay 1*a* includes a first magnet 51 and a second magnet 52. The first magnet 51 and the second magnet 52 are permanent magnets for extinguishing an arc generated between the contacts.

The first magnet 51 and the second magnet 52 are arranged apart from each other in the left-right direction. The first magnet 51 is arranged on one side of the movable contact piece 7 in the left-right direction. The second magnet 52 is arranged on one side of the movable contact piece 7 in the left-right direction. Specifically, the first magnet 51 is arranged to the left of the movable contact piece 7. Accordingly, the position between the first fixed contact 11 and the first movable contact 13 (hereinafter, referred to as "first contact position P1") is set between the first magnet 51 and the contact piece holding unit 8 in the left-right direction. The second magnet 52 is arranged on the right side of the movable contact piece 7. Accordingly, the position between the second fixed contact 12 and the second movable contact 14 (hereinafter, referred to as "second contact position P2") is set between the second magnet 52 and the contact piece holding unit 8 in the left-right direction.

The first magnet 51 and the second magnet 52 are arranged so that their same poles face each other. Specifically, the first magnet 51 includes a first surface 51S facing the movable contact piece 7 and a second surface 51N on the opposite side of the first surface 51S. The second magnet 52 includes a first surface 52S facing the movable contact piece 7 and a second surface 52N on the opposite side of the first surface 52S. The first surface 51S of the first magnet 51 and the first surface 52S of the second magnet 52 are both S poles. The second surface 51N of the first magnet 51 and the second surface 52N of the second magnet 52 are both N poles.

The relay 1*a* further includes a yoke 47. The yoke 47 connects the first magnet 51 and the second magnet 52. Specifically, the yoke 47 is connected to the second surface 51N of the first magnet 51. The yoke 47 is connected to the second surface 52N of the second magnet 52.

The relay 1*a* includes a first debris suction unit 53 and a second debris suction unit 54. The first debris suction unit 53 and the second debris suction unit 54 cause a magnetic force to act so as to suck debris generated in the contact piece holding unit 8. The first debris suction unit 53 and the second debris suction unit 54 are permanent magnets. As shown in FIG. 3, the first debris suction unit 53 and the second debris suction unit 54 are arranged apart from each other in the front-back direction. In the present embodiment, the front-back direction coincides with the width direction of the movable contact piece 7 that intersects the longitudinal direction of the movable contact piece 7.

The first debris suction unit 53 is arranged on one side in the front-back direction with respect to the movable contact piece 7. The second debris suction unit 54 is arranged on the other side in the front-back direction with respect to the movable contact piece 7. In other words, the movable contact piece 7 is arranged between the first debris suction unit 53 and the second debris suction unit 54 in the front-back direction.

The first debris suction unit 53 and the second debris suction unit 54 are arranged so as to face the contact piece holding unit 8 in the front-back direction. The first debris suction unit 53 has a length in the left-right direction that is smaller than the distance between the first movable contact 13 and the second movable contact 14 in the left-right direction. The second debris suction unit 54 has a length in the left-right direction that is smaller than the distance between the first movable contact 13 and the second movable contact 14 in the left-right direction.

The distance between the first debris suction unit 53 and the contact piece holding unit 8 in the front-back direction is smaller than the distance between the first magnet 51 and the contact piece holding unit 8 in the left-right direction. Specifically, the distance between the first debris suction unit 53 and the holder 16 in the front-back direction is smaller than the distance between the first magnet 51 and the holder 16 in the left-right direction. The distance between the first debris suction unit 53 and the drive shaft 15 in the front-back direction is smaller than the distance between the first magnet 51 and the drive shaft 15 in the left-right direction.

The distance between the second debris suction unit 54 and the contact piece holding unit 8 in the front-back direction is smaller than the distance between the second magnet 52 and the contact piece holding unit 8 in the left-right direction. Specifically, the distance between the second debris suction unit 54 and the holder 16 in the front-back direction is smaller than the distance between the second magnet 52 and the holder 16 in the left-right direction. The distance between the second debris suction unit 54 and the drive shaft 15 in the front-back direction is smaller than the distance between the second magnet 52 and the drive shaft 15 in the left-right direction.

The first debris suction unit 53 and the second debris suction unit 54 are arranged so that their same poles face each other. Specifically, the first debris suction unit 53 includes a first surface 53N facing the movable contact piece 7 and a second surface 53S on the opposite side of the first surface 53N. The second debris suction unit 54 includes a first surface 54N facing the movable contact piece 7 and a second surface 54S on the opposite side of the first surface 54N. Both the first surface 53N of the first debris suction unit 53 and the first surface 54N of the second debris suction unit 54 are N poles. The second surface 53S of the first debris suction unit 53 and the second surface 54S of the second debris suction unit 54 are both S poles.

As shown in FIG. 3, the arrangements of the first magnet 51, the second magnet 52, the first debris suction unit 53, and the second debris suction unit 54 as described above allow magnetic fluxes B1 and B2 to be generated to flow in the left-right direction between the first fixed contact 11 and the first movable contact 13. Further, magnetic fluxes B3 and B4 are generated to flow in the left-right direction between the second fixed contact 12 and the second movable contact 14. Specifically, the magnetic fluxes B1 and B2 are generated between the first fixed contact 11 and the first movable contact 13 to flow from the center in the left-right direction toward the first end portion 7*a*. Magnetic fluxes B3 and B4 are generated between the second fixed contact 12 and the second movable contact 14 to flow from the center in the left-right direction toward the second end portion 7*b*.

Therefore, when a current flows from the left to the right in the movable contact piece 7, a Lorentz force acts in the front-back direction as shown by arrows F1 and F2 in FIG. 3. Further, when a current flows from right to left in the movable contact piece 7, a Lorentz force acts in the front-back direction as shown by arrows F3 and F4 in FIG. 3. As a result, the arc is stretched in the direction indicated by the arrows F1-F4, and the arc can be extinguished quickly.

Figure 4:
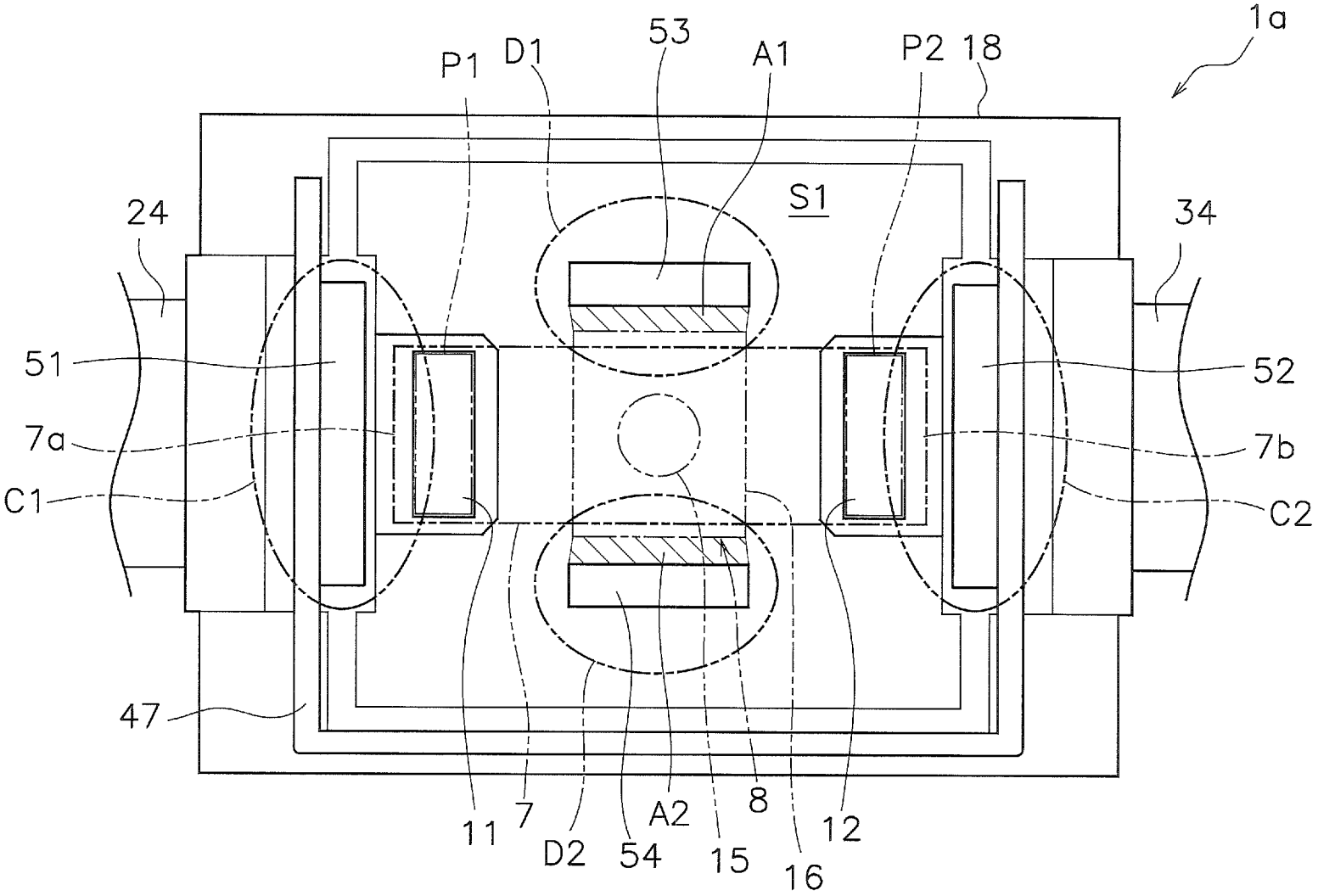
FIG. 4 is a diagram showing the strength of magnetic fluxes of the magnet and the dust suction portion according to the first embodiment.

FIG. 4 is a diagram showing an arrangement of magnetic fluxes of the first magnet 51, the second magnet 52, the first debris suction unit 53, and the second debris suction unit 54. In FIG. 4, the alternate long and short dash lines C1, C2, D1, and D2, respectively, show the positions of the magnetic fluxes having the same magnetic flux densities in the first magnet 51, the second magnet 52, the first debris suction unit 53, and the second debris suction unit 54.

As shown in FIG. 4, the position C1 of the magnetic flux of the first magnet 51 is farther from the contact piece holding unit 8 than from the position D1 of the magnetic flux of the first debris suction unit 53 and the position D2 of the magnetic flux of the second debris suction unit 54. Therefore, the magnetic flux density of the first debris suction unit 53 in the contact piece holding unit 8 is larger than the magnetic flux density of the first magnet 51 in the contact piece holding unit 8. Also, the magnetic flux density of the second debris suction unit 54 in the contact piece holding unit 8 is larger than the magnetic flux density of the first magnet 51 in the contact piece holding unit 8. Therefore, the magnetic force exerted by the first debris suction unit 53 in the contact piece holding unit 8 is larger than the magnetic force exerted by the first magnet 51 in the contact piece holding unit 8. Further, the magnetic force exerted by the second debris suction unit 54 in the contact piece holding unit 8 is larger than the magnetic force exerted by the first magnet 51 in the contact piece holding unit 8.

The position C2 of the magnetic flux of the second magnet 52 is farther from the contact piece holding unit 8 than the position D1 of the magnetic flux of the first debris suction unit 53 and the position D2 of the magnetic flux of the second debris suction unit 54. Therefore, the magnetic flux density of the first debris suction unit 53 in the contact piece holding unit 8 is larger than the magnetic flux density of the second magnet 52 in the contact piece holding unit 8. Also, the magnetic flux density of the second debris suction unit 54 in the contact piece holding unit 8 is larger than the magnetic flux density of the second magnet 52 in the contact piece holding unit 8. Therefore, the magnetic force exerted by the first debris suction unit 53 in the contact piece holding unit 8 is larger than the magnetic force exerted by the second magnet 52 in the contact piece holding unit 8. Further, the magnetic force exerted by the second debris suction unit 54 in the contact piece holding unit 8 is larger than the magnetic force exerted by the second magnet 52 in the contact piece holding unit 8.

In FIG. 4, the region A1 marked by hatching illustrates a region between the first debris suction unit 53 and the contact piece holding unit 8. The first debris suction unit 53 is arranged so that, when viewed from the moving direction of the movable contact piece 7, the first contact position P1 and the second contact position P2 do not overlap the region A1 that is located between the first debris suction unit 53 and the contact piece holding unit 8. In FIG. 3, the region A2 marked by hatching illustrates a region between the second debris suction unit 54 and the contact piece holding unit 8. The second debris suction unit 54 is arranged so that, when viewed from the moving direction of the movable contact piece 7, the first contact position P1 and the second contact position P2 do not overlap the region A2 that is located between the second debris suction unit 54 and the contact piece holding unit 8.

In the relay 1*a* according to the first embodiment described above, even if wear debris is generated in the contact piece holding unit 8, the wear debris is sucked by the first debris suction unit 53 and the second debris suction unit 54. Therefore, it is possible to reduce the risk that the wear debris could be caught between the first movable contact 13 and the first fixed contact 11 and between the second movable contact 14 and the second fixed contact 12. As a result, decrease in the energization performance due to wear debris can be reduced.

Figure 5:
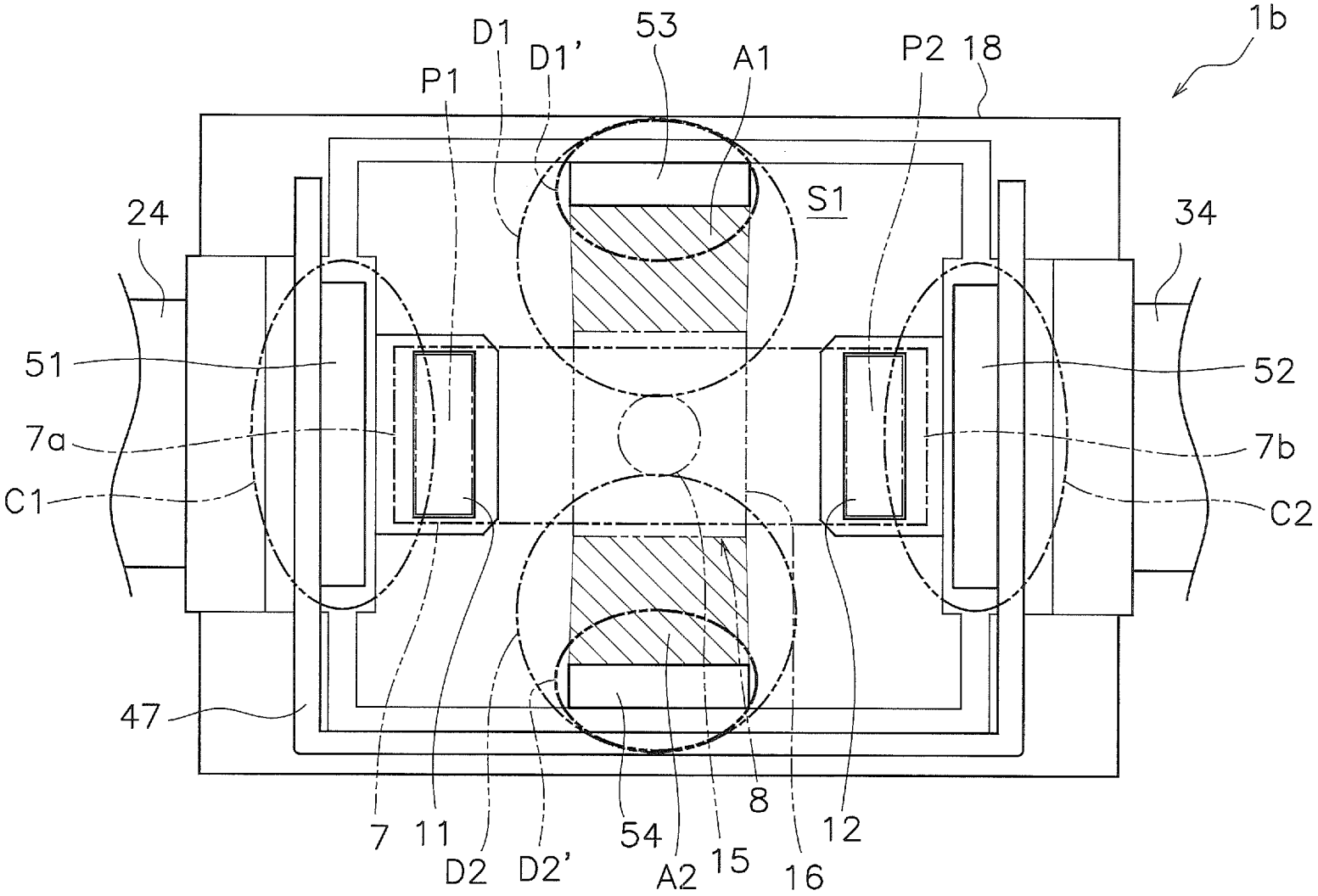
FIG. 5 is a plan view showing a configuration inside a contact case of a relay according to a second embodiment.

Although the relay 1*a* according to the first embodiment has been described above, the arrangement of the debris suction units is not limited to that of the first embodiment and may be changed. FIG. 5 is a plan view showing a configuration inside of the contact case 18 in a relay 1*b* according to a second embodiment. The other configurations of the relay 1*b* are the same as those of the relay 1*a* of the first embodiment.

In FIG. 5, the alternate long and short dash lines C1, C2, D1, and D2, respectively, show the positions of the magnetic fluxes having the same magnetic flux densities in the first magnet 51, the second magnet 52, the first debris suction unit 53, and the second debris suction unit 54, as in FIG. 4. Further, the alternate long and short dash line D1' shows the position of the magnetic flux having a magnetic flux density higher than that of the magnetic flux at the position D1 in the first debris suction unit 53. The alternate long and short dash line D2' shows the position of the magnetic flux having a magnetic flux density higher than that of the magnetic flux at the position D2 in the second debris suction unit 54.

As shown in FIG. 5, the first debris suction unit 53 and the second debris suction unit 54 are arranged far apart from the contact piece holding unit 8 as compared with the first embodiment described above. However, magnets having a stronger magnetic force than that of the first embodiment are used for the first debris suction unit 53 and the second debris suction unit 54. Accordingly, the magnetic flux density of the first debris suction unit 53 in the contact piece holding unit 8 is larger than the magnetic flux density of the first magnet 51 in the contact piece holding unit 8 and the magnetic flux density of the second magnet 52 in the contact piece holding unit 8. Further, the magnetic flux density of the second debris suction unit 54 in the contact piece holding unit 8 is larger than the magnetic flux density of the first magnet 51 in the contact piece holding unit 8 and the magnetic flux density of the second magnet 52 in the contact piece holding unit 8.

In FIG. 5, the distance between the first debris suction unit 53 and the contact piece holding unit 8 is smaller than the distance between the first magnet 51 and the contact piece holding unit 8 and the distance between the second magnet 52 and the contact piece holding unit. Also, the distance between the second debris suction unit 54 and the contact piece holding unit 8 is less than the distance between the first magnet 51 and the contact piece holding unit 8 and the distance between the second magnet 52 and the contact piece holding unit 8. However, the distance between the first debris suction unit 53 and the contact piece holding unit 8 may be equal to or greater than the distance between the first magnet 51 and the contact piece holding unit 8 and the distance between the second magnet 52 and the contact piece holding unit 8. The distance between the second debris suction unit 54 and the contact piece holding unit 8 may be equal to or greater than the distance between the first magnet 51 and the contact piece holding unit 8 and between the second magnet 52 and the contact piece holding unit 8. Even in such a case, magnets having a stronger magnetic force than the first magnet 51 and the second magnet 52 are used for the first debris suction unit 53 and the second debris suction unit 54, and thereby waste debris can be sucked by the first debris suction unit 53 and the second debris suction unit 54.

Figure 6:
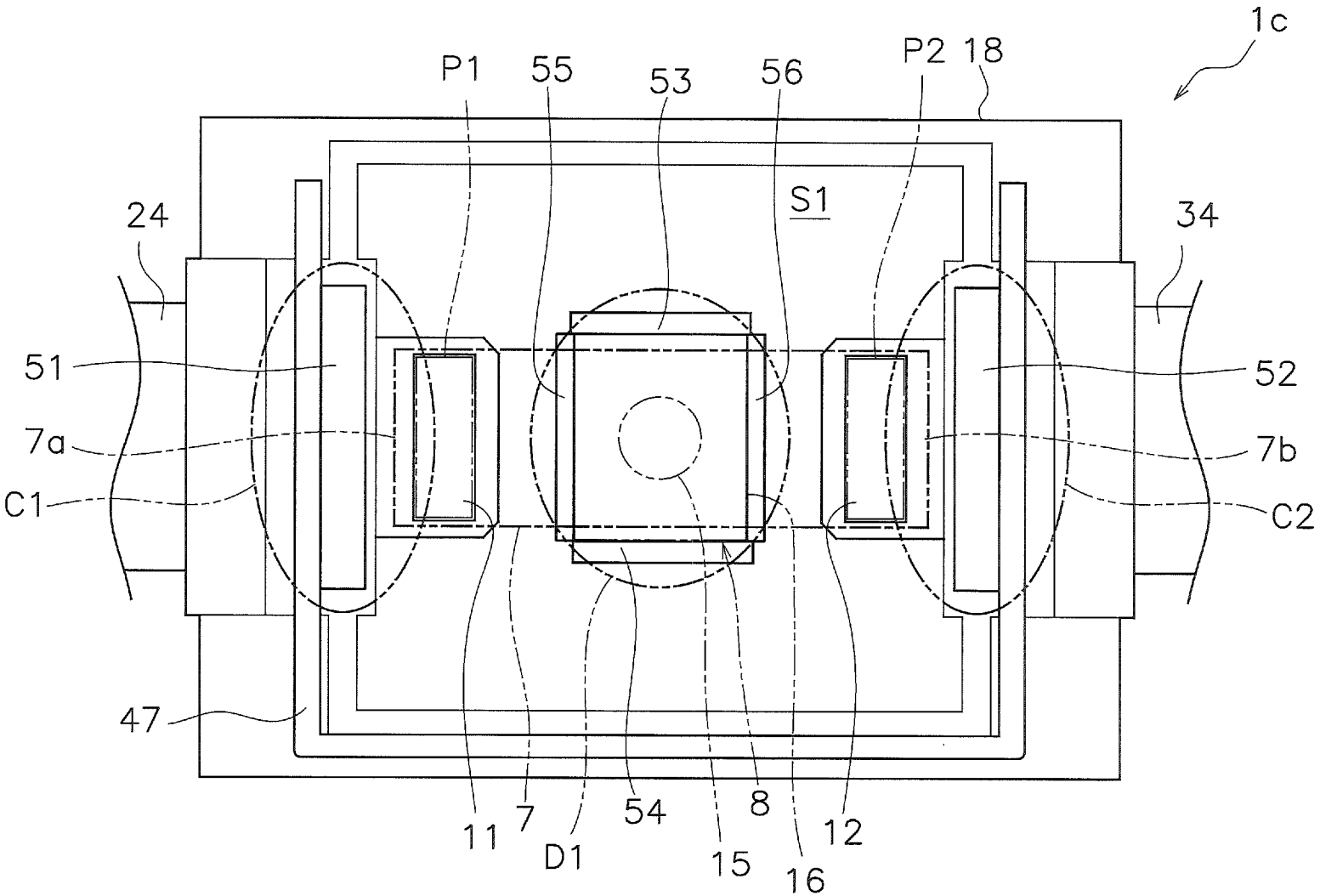
FIG. 6 is a plan view showing a configuration inside a contact case of a relay according to a third embodiment.

FIG. 6 is a plan view showing a configuration inside of the contact case 18 in a relay 1*c* according to a third embodiment. As shown in FIG. 6, the relay 1*c* includes a first debris suction unit 53, a second debris suction unit 54, a third debris suction unit 55, and a fourth debris suction unit 56. The first to fourth debris suction units 53-56 cover the contact piece holding unit 8 from the front, back, left, and right side thereof. As a result, the position D1 of the magnetic fluxes of the first to fourth debris suction units 53-56 is located so as to surround the contact piece holding unit 8 from the front, back, left, and right sides thereof.

Specifically, the first debris suction unit 53 and the second debris suction unit 54 are arranged in the front-back direction with respect to the movable contact piece 7 as in the first embodiment. The third debris suction unit 55 is located between the first contact position P1 and the contact piece holding unit 8 in the left-right direction. The fourth debris suction unit 56 is located between the second contact position P2 and the contact piece holding unit 8 in the left-right direction.

The first to fourth debris suction units 53-56 are mounted to, for example, the contact piece holding unit 8. However, the first to fourth debris suction units 53-56 may be mounted to the contact case 18. Alternatively, a part of the first to fourth debris suction units 53-56 may be mounted to the contact piece holding unit 8. A part of the first to fourth debris suction units 53-56 may be mounted to the contact case 18.

In the relay 1*c* according to the third embodiment also, similarly to the first embodiment, the first to fourth debris suction units 53-56 are able to suck the waste debris generated in the contact piece holding unit 8. Further, the waste debris generated in the contact piece holding unit 8 is sucked by the third debris suction unit 55 so as not to reach the first contact position P1 between the first fixed contact 11 and the first movable contact 13. As a result, it is possible to more effectively reduce the risk that the waste debris could be caught between the first movable contact 13 and the first fixed contact 11.

Further, the wear debris generated in the contact piece holding unit 8 is sucked by the fourth debris suction unit 56 so as not to reach the second contact position P2 between the second fixed contact 12 and the second movable contact 14. As a result, it is possible to more effectively reduce the risk that the waste debris could be caught between the second movable contact 14 and the second fixed contact 12.

Figure 7:
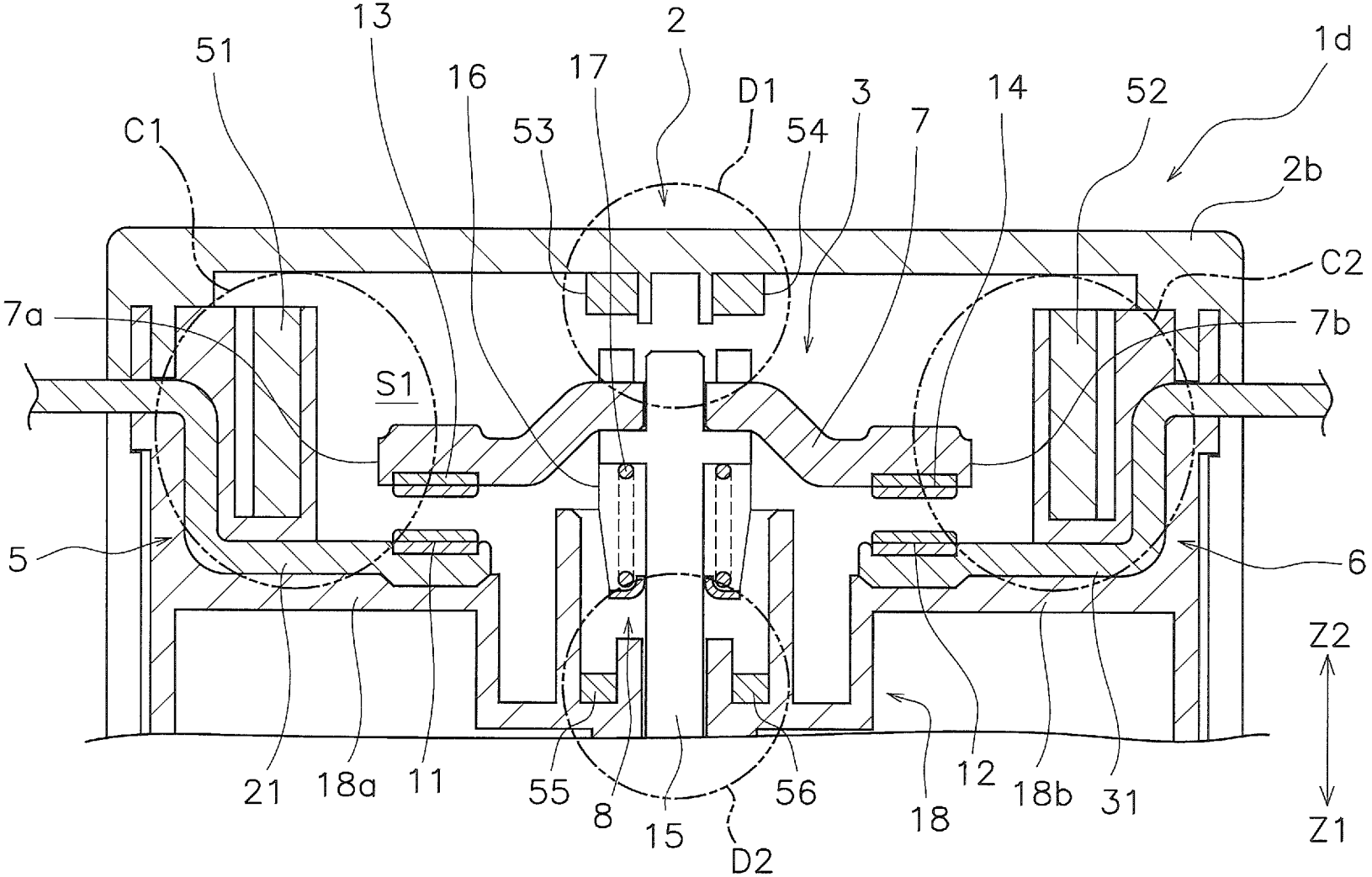
FIG. 7 is a side sectional view showing a configuration inside a contact case of a relay according to a fourth embodiment.

FIG. 7 is a plan view showing a configuration inside of the contact case 18 in a relay 1*d* according to a fourth embodiment. As shown in FIG. 7, the relay 1*d* includes first to fourth debris suction units 53-56. The first to fourth debris suction units 53-56 are arranged apart from the contact piece holding unit 8 in the moving direction of the movable contact piece 7.

Specifically, the first debris suction unit 53 and the second debris suction unit 54 are arranged apart from the movable contact piece 7 in the separating direction Z2. That is, the first debris suction unit 53 and the second debris suction unit 54 are arranged above the movable contact piece 7. The third debris suction unit 55 and the fourth debris suction unit 56 are arranged apart from the movable contact piece 7 in the contact direction Z1. That is, the third debris suction unit 55 and the fourth debris suction unit 56 are arranged below the movable contact piece 7.

The distance between the first debris suction unit 53 and the contact piece holding unit 8 and the distance between the second debris suction unit 54 and the contact piece holding unit 8 in the moving direction of the movable contact piece 7 are smaller than the distance between the first magnet 51 and the contact piece holding unit 8 and the distance between the second magnet 52 and the contact piece holding unit 8 in the longitudinal direction of the movable contact piece 7. The distance between the third debris suction unit 55 and the contact piece holding unit 8 and the distance between the fourth debris suction unit 56 and the contact piece holding unit 8 in the moving direction of the movable contact piece 7 are smaller than the distance between the first magnet 51 and the contact piece holding unit 8 and the distance between the second magnet 52 and the contact piece holding unit 8 in the longitudinal direction of the movable contact piece 7.

In FIG. 7, D1 illustrates the positions of the magnetic fluxes of the first debris suction unit 53 and the second debris suction unit 54 having the same magnetic flux densities as those at the magnetic flux positions C1 and C2 of the first magnet 51 and the second magnet 52. D2 illustrates the positions of the magnetic fluxes of the third debris suction unit 55 and the fourth debris suction unit 56 having the same magnetic flux density as those at the magnetic flux positions C1 and C2 of the first magnet 51 and the second magnet 52.

Similarly to the first embodiment, in the relay 1*d* according to the fourth embodiment, the wear debris generated in the contact piece holding unit 8 can be sucked by the first to fourth debris suction units 53-56.

Note that the third debris suction unit 55 and the fourth debris suction unit 56 may be omitted. That is, the debris suction units may be arranged only above the movable contact piece 7. Alternatively, the first debris suction unit 53 and the second debris suction unit 54 may be omitted. That is, the debris suction units may be arranged only below the movable contact piece 7.

Figure 8:
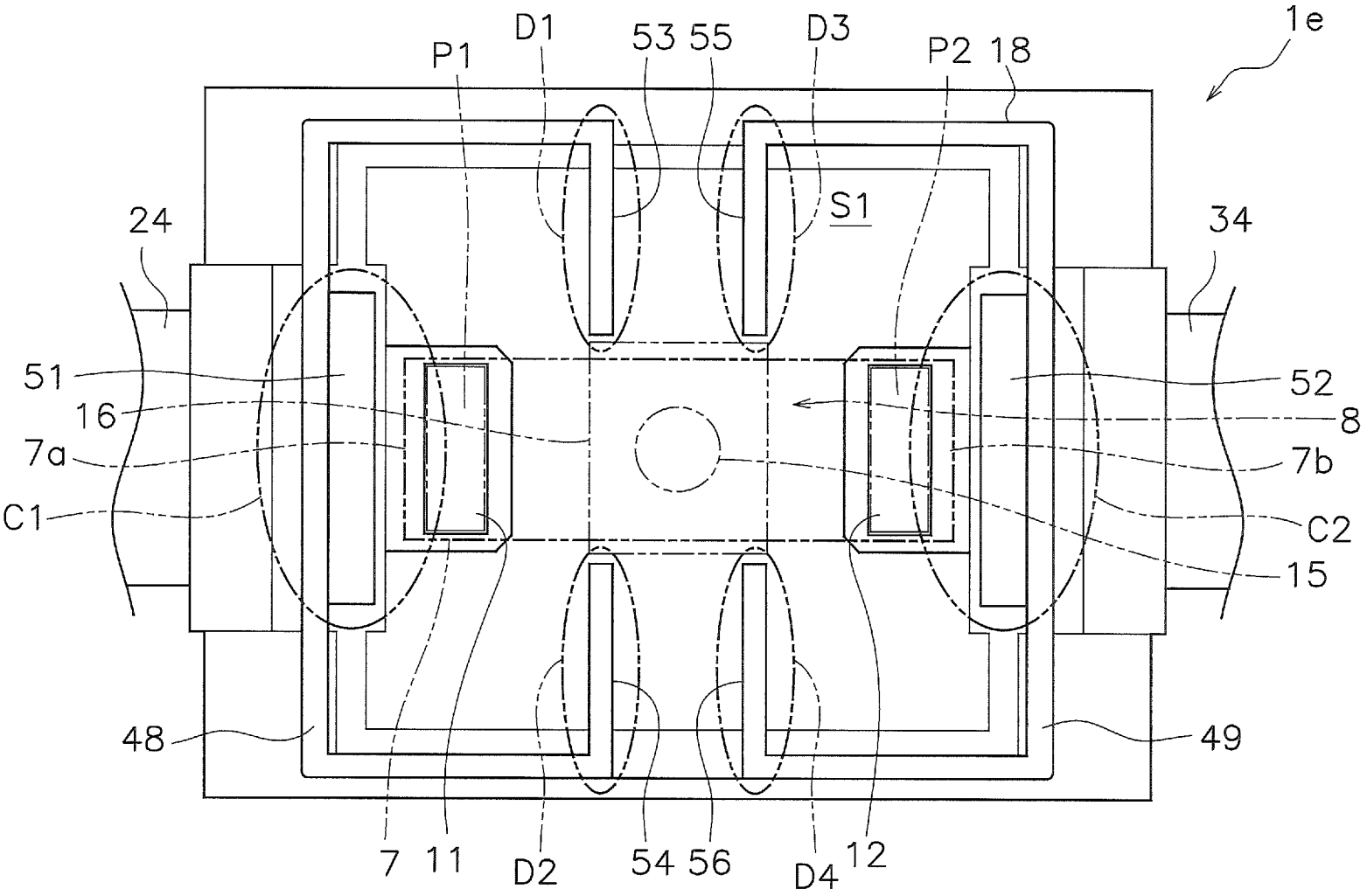
FIG. 8 is a plan view showing a configuration inside a contact case of a relay according to a fifth embodiment.

FIG. 8 is a plan view showing a plan view showing a configuration inside of the contact case 18 in a relay 1*e* according to a fifth embodiment. As shown in FIG. 8, the relay 1*e* includes first to fourth debris suction units 53-56. The first to fourth debris suction units 53-56 are yokes. The first to fourth debris suction units 53-56 are formed of a magnetic material such as iron. The first debris suction unit 53 and the second debris suction unit 54 are connected to the first magnet 51 via a first yoke 48. The third debris suction unit 55 and the fourth debris suction unit 56 are connected to the second magnet 52 via a second yoke 49.

The first debris suction unit 53 and the second debris suction unit 54 are arranged apart from each other in the front-back direction. The third debris suction unit 55 and the fourth debris suction unit 56 are arranged apart from each other in the front-back direction. The first debris suction unit 53 and the third debris suction unit 55 are arranged apart from each other in the left-right direction. The second debris suction unit 54 and the fourth debris suction unit 56 are arranged apart from each other in the left-right direction. The movable contact piece 7 is arranged between the first debris suction unit 53 and the second debris suction unit 54 and also between the third debris suction unit 55 and the fourth debris suction unit 56 in the front-back direction.

In the relay 1*e* according to the fifth embodiment, the magnetic flux generated from the first magnet 51 for extinguishing an arc is guided by the first debris suction unit 53 and the second debris suction unit 54. Also, the magnetic flux generated from the second magnet 52 for extinguishing an arc is guided by the third debris suction unit 55 and the fourth debris suction unit 56. As a result, the waste debris is sucked by the first to fourth debris suction units 53-56.

Note that the arrangement of the first to fourth debris suction units 53-56 as yokes is not limited to that of the fifth embodiment, and may be changed. For example, the first to fourth debris suction units 53-56 arranged in the relay 1*d* according to the fourth embodiment may be configured as yokes.

Figure 9:
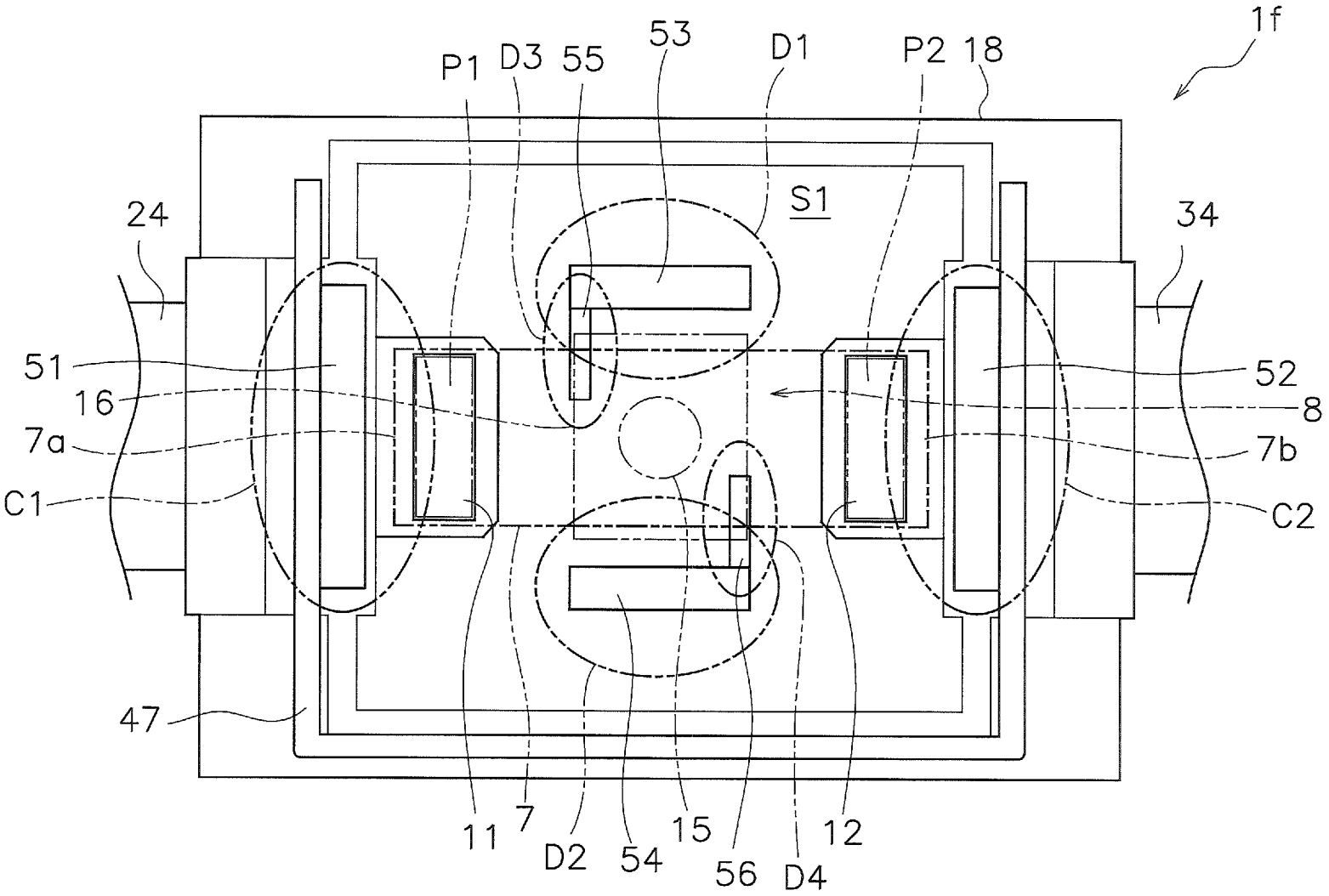
FIG. 9 is a plan view showing a configuration inside a contact case of a relay according to a sixth embodiment.

FIG. 9 is a plan view showing a configuration inside of the contact case 18 of a relay 1*f* according to a sixth embodiment. As shown in FIG. 9, the relay 1*f* includes first to fourth debris suction units 53-56. The first debris suction unit 53 and the second debris suction unit 54 are permanent magnets. The third debris suction unit 55 and the fourth debris suction unit 56 are yokes.

The first debris suction unit 53 and the second debris suction unit 54 are arranged apart from each other in the front-back direction, as in the relay 1*a* according to the first embodiment. The third debris suction unit 55 is connected to the first debris suction unit 53, and protrudes out from the first debris suction unit 53 toward the movable contact piece 7 in the front-back direction. The fourth debris suction unit 56 is connected to the second debris suction unit 54, and protrudes out from the second debris suction unit 54 toward the movable contact piece 7 in the front-back direction. The third debris suction unit 55 and the fourth debris suction unit 56 are arranged apart from each other in the left-right direction.

The contact piece holding unit 8 is located between the first debris suction unit 53 and the second debris suction unit 54 in the front-back direction. The contact piece holding unit 8 is located between the third debris suction unit 55 and the fourth debris suction unit 56 in the left-right direction. The third debris suction unit 55 is located between the first contact position P1 and the contact piece holding unit 8 in the left-right direction. The fourth debris suction unit 56 is located between the second contact position P2 and the contact piece holding unit 8 in the left-right direction.

In the relay 1*f* according to the sixth embodiment, the wear debris can be sucked by the magnetic flux that is generated from the first debris suction unit 53 and guided by the third debris suction unit 55. Further, the wear debris can be sucked by the magnetic flux that is generated from the second debris suction unit 54 and guided by the fourth debris suction unit 56.

Figure 10:
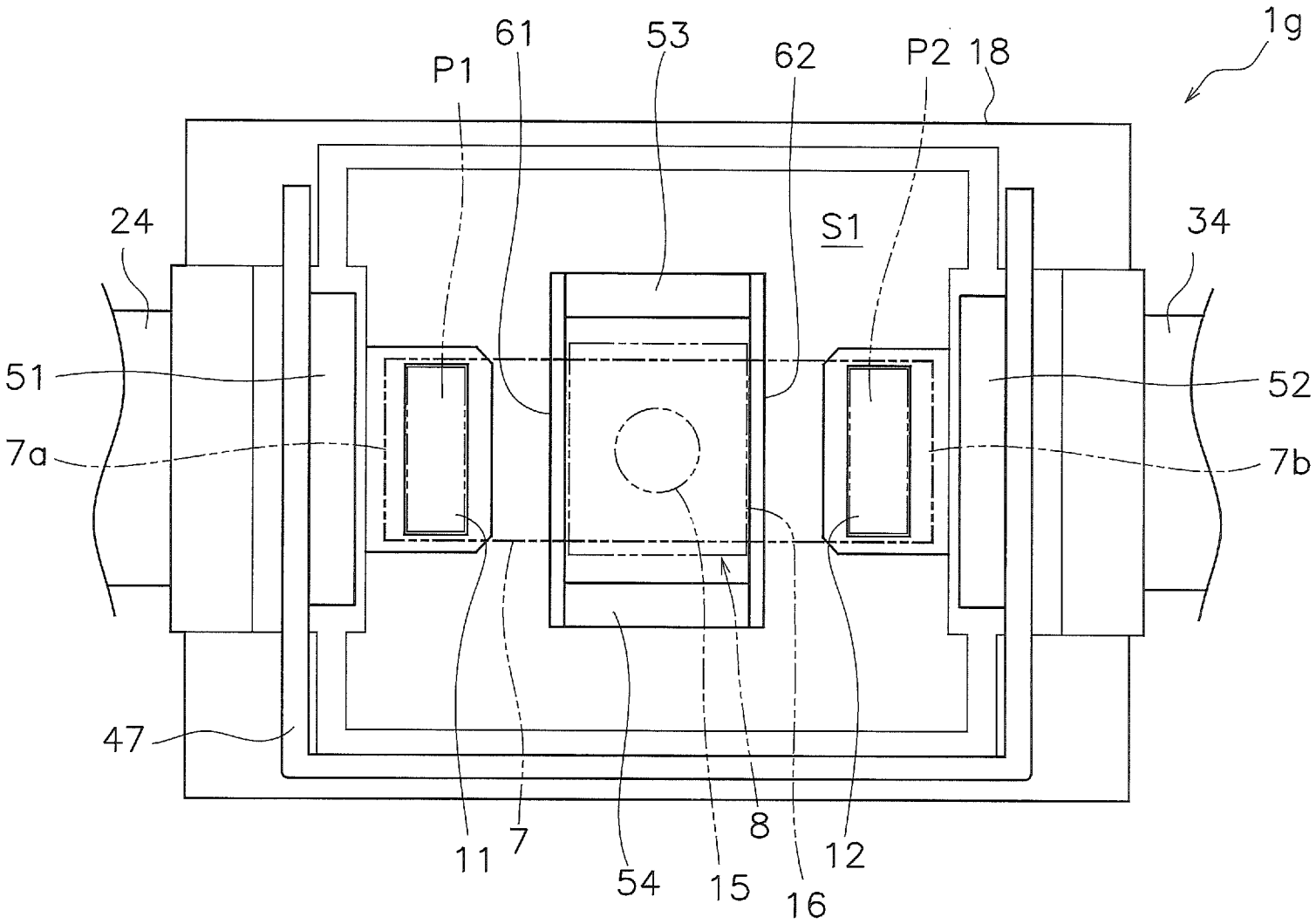
FIG. 10 is a plan view showing a configuration inside a contact case of a relay according to a seventh embodiment.

FIG. 10 is a plan view showing a configuration inside of the contact case 18 in a relay 1*g* according to a seventh embodiment. As shown in FIG. 10, the relay 1*f* includes a first debris suction unit 53, a second debris suction unit 54, a first magnetic shield 61, and a second magnetic shield 62. The first debris suction unit 53 and the second debris suction unit 54 are permanent magnets. The first debris suction unit 53 and the second debris suction unit 54 are arranged apart from each other in the front-back direction, as in the relay 1*a* according to the first embodiment. The first magnetic shield 61 and the second magnetic shield 62 are made of a magnetic material such as iron. The first magnetic shield 61 and the second magnetic shield 62 shield magnetism.

The first magnetic shield 61 is connected to the first debris suction unit 53 and the second debris suction unit 54 and extends in the front-back direction. The second magnetic shield 62 is connected to the first debris suction unit 53 and the second debris suction unit 54 and extends in the front-back direction. The first magnetic shield 61 and the second magnetic shield 62 are arranged apart from each other in the left-right direction.

The contact piece holding unit 8 is located between the first debris suction unit 53 and the second debris suction unit 54 in the front-back direction. The contact piece holding unit 8 is located between the first magnetic shield 61 and the second magnetic shield 62 in the left-right direction. The first magnetic shield 61 is located between the first contact position P1 and the contact piece holding unit 8 in the left-right direction. The second magnetic shield 62 is located between the second contact position P2 and the contact piece holding unit 8 in the left-right direction.

In the relay 1*g* according to the seventh embodiment, the magnetic force of the first magnet 51 exerted in the contact piece holding unit 8 to extinguish an arc is weakened by the first magnetic shield 61. Also, the magnetic force of the second magnet 52 exerted in the contact piece holding unit 8 to extinguish an arc is weakened by the second magnetic shield 62. As a result, the suction force of the first debris suction unit 53 and the second debris suction unit 54 on the waste debris can be relatively increased.

Although the embodiments of the present invention have been described above, the present invention is not limited to the above embodiments, and various modifications can be made without departing from the gist of the invention. For example, the configuration of the drive device 4 may be changed. The shape or arrangement of the coil 41, the spool 42, the iron core 43, the return spring 44, or the yoke 45 may be changed. The shape or arrangement of the case 2 may be changed.

In the above embodiment, the drive device 4 pulls the drive shaft 15 toward the coil 41, and thereby the movable contact piece 7 moves in the contact direction Z1. When the drive device 4 pushes the drive shaft 15 from the coil 41 side, the movable contact piece 7 moves in the separating direction Z2. However, the drive device 4 may pull the drive shaft 15 toward the coil 41 so that the movable contact piece 7 moves in the separating direction Z2. The drive device 4 may push the drive shaft 15 from the coil 41 side so that the movable contact piece 7 moves in the contact direction Z1. That is, the contact direction Z1 and the separating direction Z2 may be upside down from those in the above-described embodiment.

The shapes or arrangements of the first fixed terminal 5, the second fixed terminal 6, and the movable contact piece 7 may be changed. For example, the first fixed terminal 5 may have a shape that is angled toward the coil 41 side from the first contact support portion 21. The second fixed terminal 6 may have a shape that is angled toward the coil 41 side from the second contact support portion 31.

The first fixed contact 11 may be separate from the first fixed terminal 5 or may be integrated with the first fixed terminal 5. The second fixed contact 12 may be separate from the second fixed terminal 6 or may be integrated with the second fixed terminal 6. The first movable contact 13 may be separate from the movable contact piece 7 or may be integrated with the movable contact piece 7. The second movable contact 14 may be separate from the movable contact piece 7 or may be integrated with the movable contact piece 7.

The polarities of the first magnet 51, the second magnet 52, and the first to fourth debris suction units 53-56 are not limited to those in the above embodiments and may be changed. The arrangements of the first magnet 51, the second magnet 52, and the first to fourth debris suction units 53-56 are not limited to those in the above embodiments and may be changed. The configurations of the first to fourth debris suction units 53-56 are not limited to those in the above embodiments and may be changed.

Figure 11A:
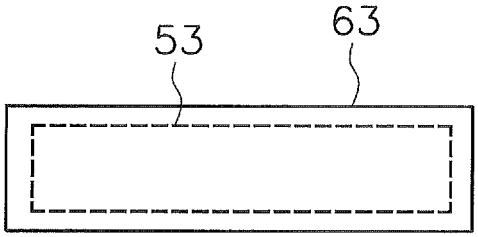
FIGS. 11A and 11B are diagrams showing a configuration of a waste adsorbing portion according to another embodiment.

For example, as shown in FIG. 11A, the first debris suction unit 53 may be covered with a cover member 63. The cover member 63 is made of, for example, resin. By covering the first debris suction unit 53 with the cover member 63 in this way, the first debris suction unit 53 can be protected from the arc generated at the contact point. Similarly, the second to fourth debris suction units 54-56 may be covered with a cover member.

Figure 11B:
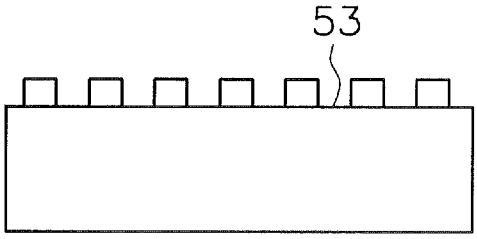

As shown in FIG. 11B, the first debris suction unit 53 may have a surface with an uneven texture. Alternatively, the cover member 63 that covers the first debris suction unit 53 may have a surface with an uneven texture. In this case, more wear debris can be collected in the first debris suction unit 53. Similarly, the second to fourth debris suction units 54-56 may have an uneven texture.

REFERENCE NUMERALS

7 Movable contact piece
8 Contact piece holding unit

11 First fixed contact
12 Second fixed contact
13 First movable contact
14 Second movable contact
51 First magnet
53 First waste suction portion
61 First magnetic shield
63 Cover member

The invention claimed is:

1. A relay comprising:
a first fixed contact;
a second fixed contact;
a movable contact piece, including a first movable contact and a second movable contact arranged apart from each other in a longitudinal direction of the movable contact piece, the movable contact piece being movably disposed in a moving direction including a first direction in which the first movable contact comes into contact with the first fixed contact and the second movable contact comes into contact with the second fixed contact and a second direction in which the first movable contact is separated from the first fixed contact and the second movable contact is separated from the second fixed contact;
a contact piece holding unit configured to hold the movable contact piece;
a magnet for arc extinguishing, the magnet being arranged laterally to the movable contact piece in the longitudinal direction of the movable contact piece; and
a debris suction unit configured to exert a magnetic force so as to suck debris generated in the contact piece holding unit,
wherein
a first contact position between the first fixed contact and the first movable contact is located between the magnet and the contact piece holding unit in the longitudinal direction of the movable contact piece,
the debris suction unit is disposed so that the first contact position does not overlap a region between the debris suction unit and the contact piece holding unit, and
the magnetic force exerted by the debris suction unit in the contact piece holding unit is larger than a magnetic force exerted by the magnet in the contact piece holding unit.

2. The relay according to claim 1, wherein
a magnetic flux density of the debris suction unit in the contact piece holding unit is larger than a magnetic flux density of the magnet in the contact piece holding unit.

3. The relay according to claim 1, wherein
the debris suction unit is disposed in a width direction intersecting the longitudinal direction of the movable contact piece with respect to the contact piece holding unit.

4. The relay according to claim 1, wherein
the debris suction unit is disposed apart from the contact piece holding unit in a width direction of the movable contact piece that intersects the longitudinal direction of the movable contact piece.

5. The relay according to claim 4, wherein
a distance between the debris suction unit and the contact piece holding unit in the width direction of the movable contact piece is smaller than a distance between the magnet and the contact piece holding unit in the longitudinal direction of the movable contact piece.

6. The relay according to claim 1, wherein
the debris suction unit is disposed apart from the contact piece holding unit in the moving direction of the movable contact piece.

7. The relay according to claim 6, wherein
a distance between the debris suction unit and the contact piece holding unit in the moving direction of the movable contact piece is smaller than a distance between the magnet and the contact piece holding unit in the longitudinal direction of the movable contact piece.

8. The relay according to claim 1, wherein
at least a part of the debris suction unit is disposed between the first contact position and the contact piece holding unit in the longitudinal direction of the movable contact piece.

9. The relay according to claim 1, wherein
the debris suction unit is a permanent magnet.

10. The relay according to claim 1, wherein
the debris suction unit includes a yoke connected to the magnet for arc extinguishing.

11. The relay according to claim 1, wherein
the debris suction unit includes a permanent magnet and a yoke connected to the permanent magnet.

12. The relay according to claim 1, further comprising:
a cover member configured to cover the debris suction unit.

13. The relay according to claim 1, further comprising:
a magnetic shield disposed between the first contact position and the contact piece holding unit in the longitudinal direction of the movable contact piece.

14. The relay according to claim 1, wherein
the debris suction unit has a surface with an uneven texture.

* * * * *